United States Patent [19]

Canterbury

[11] 4,050,516

[45] Sept. 27, 1977

[54] METHOD OF INJECTING FLUIDS INTO UNDERGROUND FORMATIONS

[75] Inventor: Robert Houston Canterbury, Hobbs, N. Mex.

[73] Assignee: Dresser Industries, Inc., Dallas, Tex.

[21] Appl. No.: 699,280

[22] Filed: June 24, 1976

Related U.S. Application Data

[63] Continuation-in-part of Ser. No. 555,778, March 6, 1975, Pat. No. 3,987,848.

[51] Int. Cl.[2] ..... E21B 43/25

[52] U.S. Cl. ..... 166/305 R

[58] Field of Search ..... 166/305, 307, 273, 274, 166/129, 183, 196, 320

[56] References Cited

U.S. PATENT DOCUMENTS

| | | | |
|---|---|---|---|
| 2,033,563 | 3/1936 | Wells | 166/320 |
| 2,757,741 | 8/1956 | O'Reilly | 166/325 |
| 3,032,111 | 5/1962 | Corley et al. | 166/332 |
| 3,319,717 | 5/1967 | Chenoweth | 166/320 |
| 3,796,261 | 3/1974 | Nutter | 166/334 |

*Primary Examiner*—James A. Leppink

*Attorney, Agent, or Firm*—Michael J. Caddell

[57] ABSTRACT

A method of injecting fluids into underground formations such as oil wells, and particularly advantageous for treating low-pressure formations having bottomhole pressures below normal tubing hydrostatic pressure, utilizes the steps of lowering into the borehole a tubing string, locating near the formation to be treated a partially pressure-balanced valve adapted to support a column of fluid in the string of tubing, and applying pressure to the column of fluid in the tubing to inject fluid through the valve and into the formation.

9 Claims, 2 Drawing Figures

METHOD OF INJECTING FLUIDS INTO UNDERGROUND FORMATIONS

CROSS-REFERENCE TO RELATED APPLICATION

This application is a continuation-in-part of a copending original application, Ser. No. 555,778 filed Mar. 6, 1975, by Robert H. Canterbury, entitled "PRESSURE BALANCED WELL SERVICE VALVE" now U.S. Pat. No. 3,987,848.

BACKGROUND OF THE INVENTION

This invention involves improvements in methods of injecting treating fluid into low-pressure oil well formations. More specifically, this invention discloses improved methods for treating low-pressure wells utilizing a partially pressure balanced valving system. The known method of treating low-pressure wells with injection fluids utilizes several known treating valves which have spring loaded checkvalve structure for allowing injecting of the fluids in precontrolled amounts into the formations.

This known method is of the type disclosed in U.S. Pat. No. 3,713,490, in the 1964–1965 *World Oil Composite Catalog,* pages 3680 and 3681, and in the Burt U.S. Pat. No. Re. 22,483. Apparatus useful in the known method of fluid injection is of the type as disclosed in U.S. Pat. Nos. 2,268,010, Re. 22,483, and U.S. Pat. No. 3,802,507.

The above mentioned method and valving devices utilize a coil spring biasing means on a checkvalve member to provide well injection valve service. The basic disadvantage with these devices and their method of operation is that the biasing means utilized must be of sufficient strength to provide a biasing force exceeding the hydrostatic pressure of the column of fluid in the tubing above the valve.

In some of the deeper wells, this results in having to use a very heavy and stiff biasing spring to obtain proper operation of the injection valve. Because of this requirement, the valve usually operates very few times successfully and becomes weakened or breaks during the method of operation.

As an alternative to the extremely heavy and stiff spring, some valve manufacturers have tried to use extremely small valve seat areas to reduce the force of hydrostatic pressure on the spring. Since the resultant downward force on the spring is determined by the pressure above the valve member, multiplied by the cross-sectional area of the valve flow area it is applied to, these designs were made with small flow areas to reduce the downward force of the column of fluid.

While these designs were partially successful in reducing spring failure, they resulted in causing an even greater problem and that involved plugging of the valve flow area. Since most tubing contains some sediment, scale, rust and other foreign matter, the injection of treating fluids and acids down the tubing always breaks loose a quantity of this material which accumulates at the valve mechanism and effectively plugs it up.

The present invention overcomes these disadvantages by providing a method wherein fluid may be injected into a well through apparatus utilizing only a moderate biasing force to hold the hydrostatic pressure of the column of fluid in the tubing. This method utilizes a partial pressure balancing of the valving mechanism to reduce the hydrostatic force on the biasing means and prevent plugging of the valve flow area.

DESCRIPTION OF THE PREFERRED EMBODIMENTS

Figure 1:
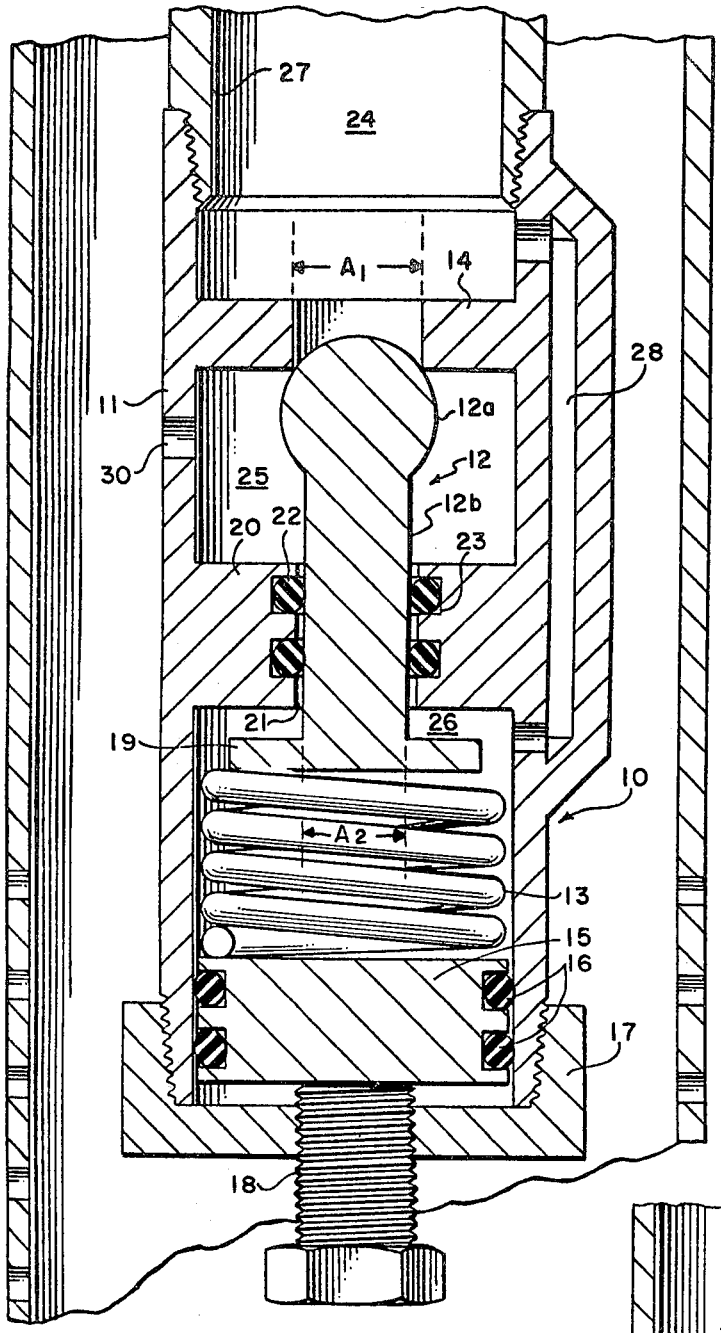
FIG. 1 is a schematic cross-sectional view of the injection valve assembly utilized in this invention.

Referring now to FIG. 1, the pressure-balanced service valve 10 is shown in cross-section having a generally tubular elongated body 11 in which is slidably located a valve member 12. A compression coil spring 13 abuts valve member 12 and urges valve member 12 into sealing engagement with valve seat 14 secured to the inner wall of housing 11. A slidable abutment base 15 is located in the bottom of housing 11 and is sealingly engaged therein by means of circular seal 16. Abutment base 15 provides a slidable base for the abutment of spring 13. A housing cap 17 is secured at the lower end of housing 11 and closes off the bore passage therethrough. A threaded adjustment member 18 is threadedly engaged in cap 17 extending upward into housing 11 for abutment with base 15 to provide compression adjustments for spring 13.

Likewise, valve member 12 has a widened base 19 to provide an abutment surface for the upward end of coil spring 13. Valve member 12 comprises upper generally spherical seating end **12*a*, an elongated generally cylindrical valve body 12*b*, and the aforementioned spring abutment face 19 at the lower end thereof. Housing 11 has an inwardly projecting shoulder 20 forming an annular partition in housing 11 through which member 12 passes, with section 12*b* being in close proximity to the inner bore 21 in partition 20. One or more circular seals 22 are provided in grooves 23 in inner bore 21 which circular seals sealingly contact elongated valve body 12*b*.**

The inner bore passage 24 of the tubing string is divided by the annular sealing shoulder 14 and sealing partition 20 into a valve flow chamber 25 and a pressure-balance chamber 26. Flow of fluids down the tubing string 27 may progress through bore 24 and chamber 25 into the formation and flow by means of a bypass channel 28 into chamber 26. Fluids in chamber 26 are restricted therein by the various seal members 16 and 22 so that no fluid may escape therefrom.

Likewise, fluid flow between chambers 25 and 26 is also prohibited. The flow of fluids through bypass channel 28 from bore passage 24 to pressure chamber 26 results in a pressure force upward on member 12 which is directly proportional to the area swept by circular seals 22, said area being designated in FIG. 1 by the dimension $A_2$ and being circular in shape or corresponding in shape to the cross-sectional configuration of section **12*b* of valve member 12.**

Likewise, a downward pressure occurs across the area atop valve member **12*a*, which pressure is equivalent to the area of the opening in valve seating shoulder 14, said area being designated at $A_1$. The total resultant pressure acting on valve member 12** is thus related to the difference in areas $A_1$ and $A_2$. This is respresented by the relation $F = P(A_1 - A_2)$.

Thus, it can be seen that by varying the areas $A_1$ and $A_2$ the resultant differential pressure on valve member 12 may be made as large or as small a proportion of the downward pressure in the tubing as required or desirable. In a deep well requiring a high hydrostatic pressure in the tubing because of the height of the fluid column therein, the difference $A_1 - A_2$ would advantageously be made small because of the high pressure involved. In a shallower well, the difference $A_1 - A_2$ would preferably be made larger. Thus, the biasing force upward provided by spring 13 to maintain member 12 seated in valve seat 14 prior to the injection operation need only be an amount greater than the resultant differential pressure acting downward on valve member 12. As an alternative to altering the pressure differential area $A_1 - A_2$ for different depts of use, it is clear that a single value of $A_1 - A_2$ for generally mid-range depths may be selected and a fine tuning of the valve for each individual well depth may be obtained by the adjustment of threaded abutment screw 18 upward or downward as the case may be.

For the deeper wells, screw 18 is threaded upward to further compress biasing spring 13 and provide a greater biasing force against the greater hydrostatic head of the fluid column in the tubing. In the shallower wells, screw 18 should be threaded downward to relieve a portion of the biasing force of spring 13 upward against valve member 12 due to the lesser hydrostatic head of the shorter column of fluid in the tubing.

In typical operation, when it is desirable to place a treating fluid on the face of a formation with this invention, the characteristics of the formation including the formation pressure and formation depth are utilized to calculate the hydrostatic head of the fluid that will exist with a full column of fluid in the tubing. From these calculations, the downward resulting differential pressure on valve member 12 is calculated using the formula $P \times (A_1 - A_2)$ and the amount of spring biasing force required to overcome this is introduced by the adjustment of spring 18 against spring base 15 thereby compressing spring 13 to the calculated extent. This establishes a biasing force against valve member 12 calculated to be greater than the resulting downward pressure on member 12 when the valve is in place opposite the formation with a column of fluid thereabove.

The valve is then placed at the lower end of the tubing string below a standard packer such as that disclosed in U.S. Pat. No. 3,548,936 to Kilgore et al, dated Dec. 22, 1970 and U.S. Pat. No. 3,701,382 to Williams, dated Oct. 31, 1972. A bypass valve in the packer is opened and the string is run in the hole with the well fluid being allowed to flow through the bypass valve in the packer and into the tubing string to offset buoyancy of the string. After the string is located properly, with the injection valve 10 in close proximity to the formation face, the packer is set by means such as wireline set, mechanical manipulation of the tubing, or hydraulic set, and the annulus below the packer near the formation is isolated from the rest of the annulus above the formation.

It may then be desirable to circulate out the well fluid existing in the isolated area of the annulus to prevent contamination of the formation by this fluid. This may be accomplished by opening a bypass valve in the packer and pumping the treating fluid into the tubing thereby displacing the well fluid up through the bypass valve into the annulus above the packer. The pumping of fluid through valve 10 during this displacement is accomplished by pressuring the tubing a sufficient amount to overcome the resultant biasing force upward on spring 13 on member 12, thereby forcing member 12 downward through partition 20, opening the bore through seat 14 and communicating ports 30 in the wall of housing 11 with flow area $A_1$.

After displacement of the well fluid has occurred and it is calculated the treating fluid has reached valve 10 and into the isolated area of the annulus, the bypass valve in the packer is closed by manipulation of the string or by other known means and injection of the treating fluid into the formation is accomplished by either continuing the fluid pressure on the tubing or else by increasing the pressure on the tubing to provide a faster injection rate. After the calculated desirable amount of treating fluid has been injected into the formation, it is usually desirable to allow the fluid to set in the formation an extended period of time to maximize the desirable effect gained from the treating fluid. This may be done by releasing pressure on the tubing which thus removes a major portion of the resulting downward differential pressure on valve member 12. The remaining differential pressure on 12 is insufficient to maintain spring 13 compressed and thereby spring 12 moves back upward to set in seat 14 closing off flow from the formation back through the tubing string.

After the treating fluid has been held in the formation the desired period of time, the fluid may be removed from the formation either by means of a shear sleeve or other type of circulating valve between the packer and the injection valve 10 or else the bypass valve through the packer may be opened to allow the fluid to move back up the annulus. After the fluid has been removed from the formation, the string may be pulled from the casing and the treating valve removed from the tubing string to be reused in other wells an indefinite number of times. Thus, it can be seen that by using a pressure relief bypass channel 28, the hydrostatic pressure in the tubing string may be communicated with the lower side of the valve member as well as the upper side and, by proper selection of the pressure areas on valve member, a desirable differential area $A_1 - A_2$ may be established requiring only a relatively resilient low force biasing spring 13 to overcome the downward pressure on member 25 arising from the hydrostatic head. By utilizing a hydrostatic balancing chamber 26 isolated from the flow chamber 25 yet in communication with member 12, a partial pressure-balancing of member 12 may be achieved in order to offset a large portion of the downward hydrostatic pressure existing under the column of fluid in the tubing without allowing any of the fluid to leak out of the pressure-balancing area and into the flow area.

Figure 2:
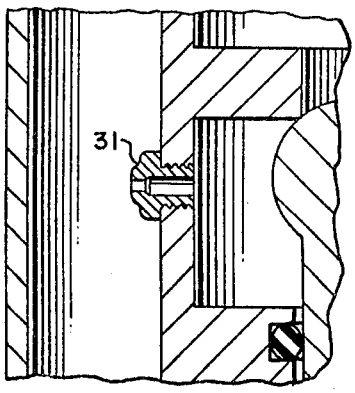
FIG. 2 is a partial schematic cross-sectional illustration of an alternate structure for use in the method of this invention.

Referring now to FIG. 2, a partial cross-sectional area of flow member 10 is shown wherein a modification of flow ports 30 is disclosed. In the embodiment of FIG. 1, a number of ports 30 through the wall of housing 11 may be varied from one to as many as will fit the periphery of the housing around chamber 25. Preferably, the flow areas through ports 30 are made as large as structurely feasible to provide as low resistance flow as possible.

In the second embodiment in FIG. 2, a modification of the flow ports 30 is provided to obtain additional action from the treating fluid in the formation area. In this embodiment, the number and location of flow port means through the wall of housing 30 are more critical than the location and configuration of ports in FIG. 1. In this embodiment, a number of spraying nozzels 31 are secured in the port openings 30 by means such as welding or threading. The spray nozzels are directed at the formation face and into the annular area around valve 10 so that during the injection of the treating fluid, the fluid is sprayed into the formation face and around the tool to provide a washing jet action to further increase the desirable effects of the treating fluid on the formation. For instance, in some of the wells to be treated, one of the problems attempted to be overcome involves the build-up of paraffin in the formation flow area and in the perforations in the casing. The build-up of paraffin can greatly reduce and even stop the flow of hydrocarbons from the formation into the borehole. Some paraffin build-ups are extremely hard to dissolve and the treating fluids must be strong and must be left in place a great period of time to be effective against such build-ups.

In these circumstances, use of the embodiment in FIG. 2 is particularly advantageous in that the agitation of the treating fluid against the formation face serves to increase many-fold the action of the fluid on the paraffin deposits. Operation of the tool of FIG. 2 is substantially identical to that of the embodiment of FIG. 1.

The jetting system of FIG. 2 is also useful for allowing a washing action on the formation after the injection treatment has been accomplished. A washing fluid may be injected behind the treating fluid and sprayed through jets 31 against the formation to remove sediment, deposits, and residue from the injection treatment. Although certain preferred embodiments of the present invention have been herein described in order to provide an understanding of the general principles of the invention, it will be appreciated that various changes and innovations can be affected in the described valve structure without departure from these principles. For example, whereas a method utilizing a vertically upward acting valve member is disclosed, it is clear that the method also encompasses the use of said structure in an inverted configuration from that shown with a biasing means pushing the valve member downward and the resulting partial differential pressure on the valve member resulting in an upward force from the hydrostatic fluid pressure. Thus, all modifications and changes of this type are deemed to be embraced by the spirit and scope of the invention except as the same may be necessarily limited by the appended claims or reasonable equivalence thereof.

The embodiments of the invention in which an exclusive property or privilege is claimed are defined as follows:

1. A method of injecting fluids into an underground formation penetrated by a wellbore, said method comprising:

predetermining the hydrostatic pressure of a column of fluid having a height equal to the depth of the underground formation;

providing a continuously partially pressure-balanced injection valve having a resultant differential pressure area responsive to the hydrostatic pressure of a colume of fluid thereabove to open said valve, and having an adjustable biasing means arranged to apply a closing force to said valve;

adjusting said injection valve biasing means to a force exceeding the resultant differential pressure on said valve which would arise from said predetermined hydrostatic pressure;

locating said injection valve in a tubing string in the under ground formation;

placing in the tubing string treating fluid to be injected into the formation;

filling any remaining portion of the tubing string with displacement fluid; and, applying fluid pressure to the tubing string to open said injection valve and inject said treating fluid into the formation.

2. The method of claim 1 further comprising the steps of:

removing said pump pressure on said tubing string when the desired amount of treating fluid has been injected into the formation;

allowing said treating fluid to sit against the formation an extended period of time; and, pumping additional displacement fluid into the tubing string to circulate said treating fluid out of the well.

3. A method of injecting through a wellbore a precisely controlled amount of fluid into an underground formation having a formation pressure substantially less than the hydrostatic pressure of a full column of fluid in the wellbore above the formation; said method comprising:

locating in the wellbore a tubing string having flow port means near the formation;

placing in said tubing string near said formation and extending above the flow port means a valve member having a first pressure response area open to said tubing string, in valving relationship therein, and responsive to fluid pressure in the tubing string;

simultaneously communicating said tubing string to a second, lesser pressure response area on the valve member opposing said first area;

continuously and resiliently biasing said valve member towards a closed position in said tubing string with a biasing force exceeding the differential pressure force from a full column of fluid in the tubing above the valve member acting on the difference in area between said first and second pressure response areas; and, then pumping the desired injection volume of fluid into the full tubing with sufficient pressure to overcome said resilient biasing force and open said valve member.

4. The fluid injection method of claim 3 further comprising the steps of:

including in said port means spray nozzle means directed radially outward; and, introducing additional fluidic pressure during said pumping step and thereby jet washing said formation.

5. The fluid injection method of claim 3 further comprising the steps of:

removing said pump pressure from said tubing thereby allowing said biasing means to close said valve member;

allowing said valve member to remain closed an extended predetermined period of time; and, repeating said pumping steps one or more times.

6. The method of treating through a conduit string in a wellbore an underground formation having a formation pressure below normal hydrostatic head at that depth; said method comprising:

a. locating in a conduit string a partially and continuously pressure-balanced injection valve assembly;

b. forming through the wall of said conduit string one or more flow ports communicating with said valve assembly;

c. locating in said conduit string above said flow ports a packer assembly having first and second bypass valve means therein;

d. lowering the conduit string into the wellbore with the first bypass valve means open to allow fluid to enter the string from the wellbore;

e. placing the conduit so that the flow ports are in close proximity to the formation to be treated;

f. closing the first bypass valve means and setting the packer in the casing to isolate the annulus below the packer;

g. placing a predetermined amount of treating fluid into the conduit string on top of the existing fluid in the string;

h. opening the second bypass valve means in the packer for allowing fluid to flow from the annulus below the packer to the annulus above the packer;

i. filling the remainder of the conduit string with displacement fluid;

j. calculating the amount of fluid existing in the conduit string below the treating fluid;

k. pumping into the conduit string, under sufficient pressure to open said valve assembly, an amount of displacement fluid substantially equal to said calculated amount of existing fluid, thereby displacing said existing fluid up the annulus through said second bypass valve means;

l. closing said second bypass valve means; and, m. pumping into the conduit string a volume of displacement fluid generally equivalent to said treating fluid volume, under sufficient pressure to open said valve assembly, thereby injecting said treating fluid into the desired formation.

7. The formation method of claim 6 further comprising the steps of:

n. removing the pump pressure on the conduit string and allowing said treating fluid to remain in the formation an extended period of time; and, o. opening said second bypass valve means and circulating said treating fluid out of the well by pumping a sufficient quantity of displacement fluid into the conduit under sufficient pressure to open said valve assembly.

8. The formation treating method of claim 7 further comprising the steps of:

p. introducing another predetermined volume of a treating fluid into the conduit string; and, q. repeating said steps (i) through (o).

9. The formation treating method of claim 8 comprising repeating said steps (p) and (q) one or more times.

* * * * *